United States Patent [19]

Lyons et al.

[11] 3,955,311

[45] May 11, 1976

[54] MECHANISM FOR MOVING AN UPPER APPENDAGE OF A TOY FIGURE

[75] Inventors: Paul Anthony Lyons, Darenth Kent; William Frederick Clark, Chingford, both of England

[73] Assignee: Lesney Products & Co., Ltd., London, England

[22] Filed: Sept. 23, 1974

[21] Appl. No.: 508,032

[52] U.S. Cl. ..... 46/119; 46/163; 46/173

[51] Int. Cl.[2] ..... A63H 13/04

[58] Field of Search ..... 46/119, 120, 163, 173

[56] References Cited

UNITED STATES PATENTS

| | | | |
|---|---|---|---|
| 3,425,153 | 2/1969 | Bonnano et al. | 46/119 |
| 3,713,252 | 1/1973 | Bear et al. | 46/119 |
| 3,758,982 | 9/1973 | Lemelson | 46/119 |

*Primary Examiner*—Louis G. Mancene
*Assistant Examiner*—Robert F. Cutting
*Attorney, Agent, or Firm*—Ryder, McAulay, Fields, Fisher & Goldstein

[57] ABSTRACT

A push button in the upper side of the torso of a toy figure is hand operated. By pushing the button this motion is transmitted to a lever which is rotated upwardly. The upward motion of the lever is translated into a rotary motion of a ball joint which is connected to an upper arm of the toy figure. By movement of the push button the arm of the toy figure is thus moved from a preselected position into an upward position. A connection between the upper and lower arm portions permits the lower arm portion to continue movement after the upper arm portion has stopped thereby imparting a life-like movement to the figure.

10 Claims, 7 Drawing Figures

MECHANISM FOR MOVING AN UPPER APPENDAGE OF A TOY FIGURE

BACKGROUND

In a toy figure for children it is most desirable that the figure is as life-like as possible. This invention involves a mechanism which is simple to operate and permits a child to move an arm of a toy figure. The button actuating the mechanism is in the side of the upper torso and is readily accessable. By moving the button this motion is translated by the mechanism of this invention into rotary motion of the arm of the figure. In a preferred embodiment the figure is in the form of a pirate and the lower arm portion of the figure (which is movably connected to the upper arm portion) carries a cutlass. By actuating the mechanism through the push button the cutlass holding arm portion swings upwardly after the upper arm portion has stopped rotating, thereby imparting a life-like fencing movement to the figure. The mechanism of this invention is easily operated, inexpensive to make and reliable in operation.

U.S. Pat. No. 3,699,713 shows a mechanism for moving an appendage. However, the mechanism of this invention is an improvement over that shown in that patent.

Another feature of this invention is a particular form of joint between the upper and lower torso permitting the body of the toy figure to be flexed in a life-like manner.

BRIEF DESCRIPTION OF A PREFERRED EMBODIMENT OF THE INVENTION

The mechanism of this invention comprises a push button which when pushed inwardly into the torso of the toy figure contacts one end of the arm of a level. The lever is pivoted intermediate its ends, and the other end of the lever is raised upwardly by the motion of the push button. That end of the lever is positioned in a rigid loop connected to a boss which is rotated when the lever is moved upward by the push button. That boss is connected to a ball joint which is connected to an arm. By pushing the button inwardly the arm of the figure is thus raised upwardly and in one form of the invention a cutlass is attached to the arm. When the button is thus pushed forward the cutlass is raised by the arm of the figure.

Another aspect of the invention is an inverted double cup joint (see FIG. 2) which connects the upper torso with the lower torso. The connection permits both the upper and lower torso to be moved both forwardly, backwardly and sidewardly. That joint therefore provides a life-like aspect to the toy figure in which it is incorporated.

Still another aspect of the invention is a clutch mechanism (shown in FIGS. 5 and 6) which permits the arm of the figure to be manually set in a desired position or orientation.

DESCRIPTION OF A PREFERRED EMBODIMENT

Figure 1:
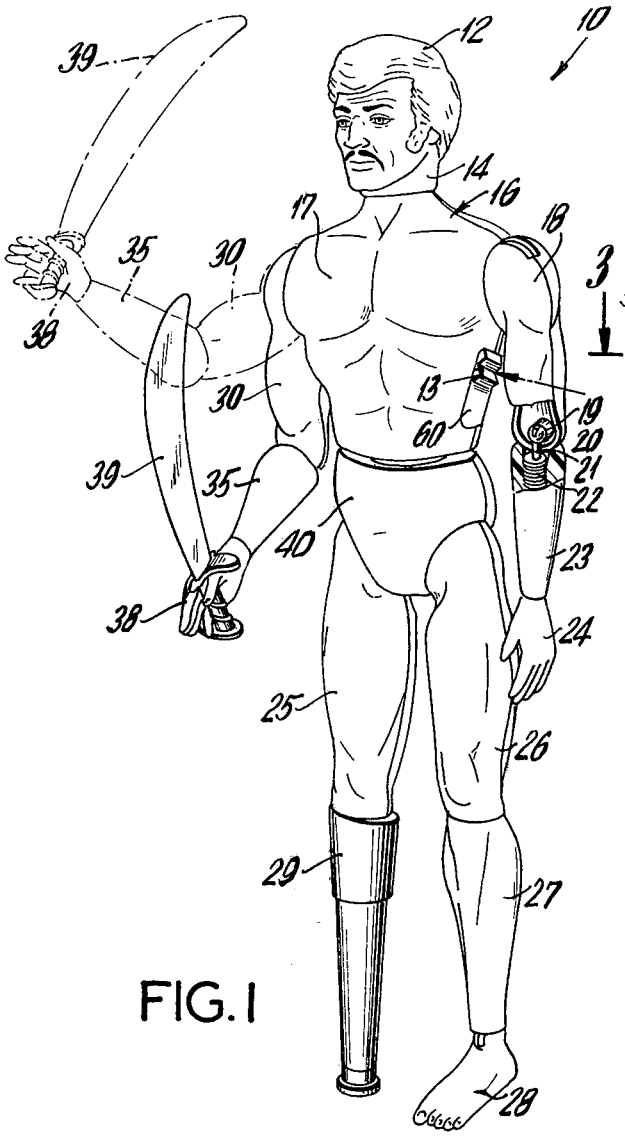
FIG. 1 is a front view of a toy figure having a mechanism for moving an arm of the figure according to the invention of this application.

The toy figure with which the invention of this application is used is depicted generally in FIG. 1. That toy figure depicted generally as 10 FIG. 1 includes as major elements head 12, neck 14 (connected to upper torso 16 by plug 46), upper torso 16, lower torso 40, upper left arm portion 18, lower left arm portion 20, left hand 24, upper left leg 26, lower left leg 27 and foot 28. In the particular figure shown in FIG. 1 the right lower right leg is missing and is replaced by a peg-leg 29. Upper right arm 30 is connected to lower right arm 35 in the manner noted below. The right hand 38 of the figure holds a cutlass 39.

Figure 2:
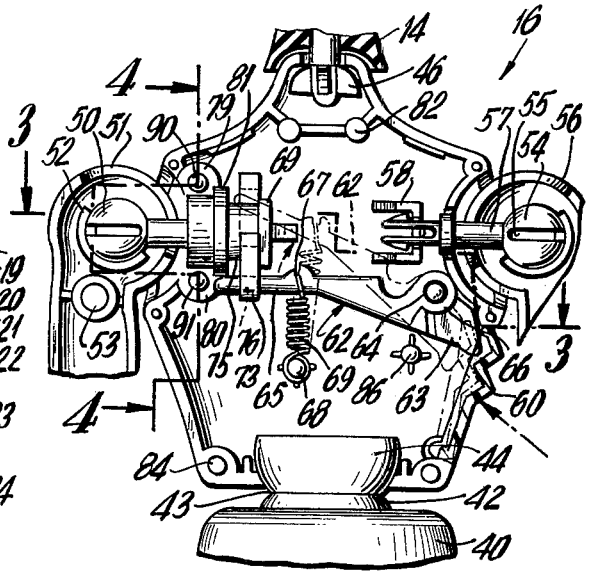
FIG. 2 is a detailed front view of the mechanism contained in the upper torso of the toy figure, with parts removed in the interest of clarity.
Figure 4:
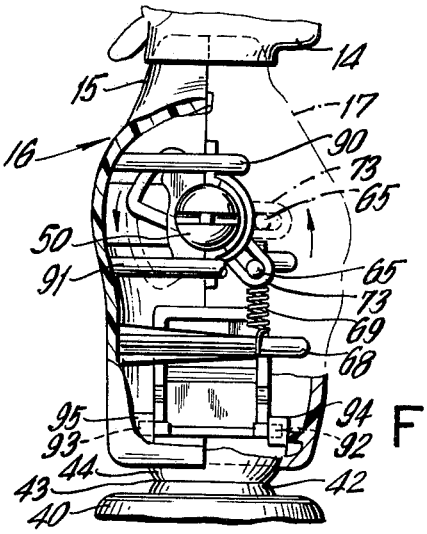
FIG. 4 is a sectional view of the upper torso of the toy figure taken along line 4—4 of FIG. 2.

The toy figure may be made of any suitable substance. However, for economy and ease of operation and fabrication it is preferred to use a plastic material. The upper torso 16 is composed of a rear portion 15 and a front portion 17 as shown in FIG. 4. The rear portion 15 is attached to the front portion 17 through the means of pins such as 82, 84 and 86 as shown in FIG. 2. These pins fit into mating female portions (not shown) on the inner part of front torso portion 17 (FIG. 4).

Figure 3:
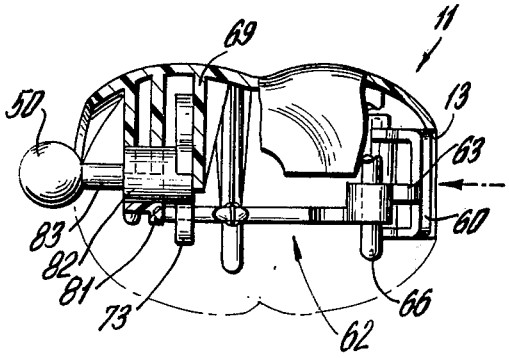
FIG. 3 is a sectional view taken along line 3—3 of FIG. 2.

Referring to the drawings, the arm actuating mechanism of this invention is shown generally as 11 in FIG. 3. It comprises (see FIGS. 1 – 3) a button 60 located within a cut-out portion 13 of the upper torso 16 of FIG. 10. As stated, FIG. 10 and all of its parts are preferably made of plastic. At each side of the bottom of button 60 are cylindrical tabs 92 and 93 (FIG. 4) which project into mating receptacles 94 and 95 in upper torso 16 of FIG. 10. Button 60 pivots on those tabs. At the top of bottom 60 are additional cylindrical tabs (not shown) effectively making it larger than the cut-out portion 13, and preventing it from moving outside upper torso 16. Button 60 bears on foot portion 63 of lever 62. Lever 62 also includes a journal portion 64 and an end portion 65. Journal portion 64 has a hole in it in which is fitted rod 66 and on which lever 62 rotates when buton 60 is pushed inwardly. End portion 65 of lever 62 passes through loop 73. Lever 62 at its end 65 has a notch 67 to which is connected spring 69 at one end and secured to pin 68 at its other end. The spring 69 serves to return lever 62 to its normal position shown in FIG. 2.

Loop or ear 73 (see FIG. 6) has an elongated cut-out portion 74 in which end 65 of lever 62 is positioned. Loop 73 is integrally connected to cylindrical or boss portion 75 which has a circular recess 71 in it and a number of teeth 77 on the periphery of the recess to provide an internal gear (the operation of which will be later described). Loop 73 through boss 75 is joined to shafts 82 and 83 which are attached to ball 50. Ball 50 is frictionally fit into socket 52 of the upper arm 30 of FIG. 10. Loop or ear 73 is connected to shaft 82 by a snap fit of plug 87 (FIG. 6) through hole 76 of boss 75. Shaft 82 (see FIG. 3) is rotatably mounted in a semi-circular cut-out portion of support 81 connected to the back 15 of upper torso 16. Ball 50 is frictionally fit within socket 52. Collar 78 has ears 79 and 80 which fit over pins 90 and 91 and cylindrical portion 81 of collar 78 holds shafts 82 and 83 in place. Pins 90 and 91 mate in receptacles (not shown) in the front half 17 of upper torso 16.

The button 60 and lever 62 comprise pivotally mounted operating means for rotation about a first axis. Ball 50 and socket 52 comprise means for rotating upper arm 30 about a second axis substantially perpendicular to that first axis. Loop 73 and the related assembly 75 – 83 shown in FIG. 6 comprise connecting means interconnecting the operating means with the rotation means.

Figure 5:
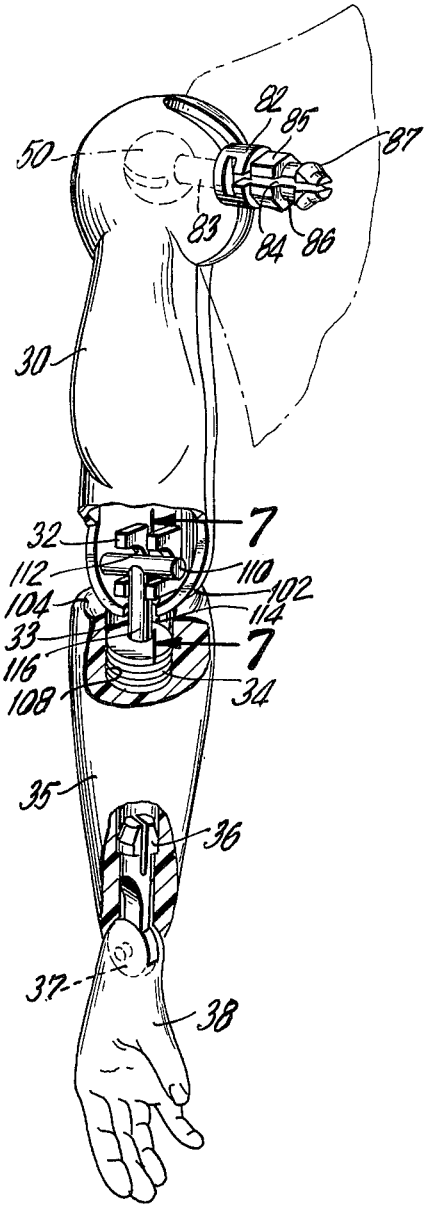
FIG. 5 is a perspective view of the right arm of the toy figure with parts broken away and other parts partially in section.

Upper right arm 30 is composed of two parts (one is shown as 31 in FIG. 2), and those parts are held together by rods (not shown) which mate and frictionally fit into receptacles such as 53 shown in FIG. 2. As shown in FIG. 5, the lower portion of upper arm 30 is rounded at 102 and is received in a complementary formed recess 104 in the lower arm 35. The upper and lower arms are joined by a loose connection designated generally by the reference character 106 which permits relative movement therebetween. More particularly, the connection 106 comprises T-shaped member 33, the vertical shaft portion 116 of which is affixed to arm portion 35 by a plug 34 that is frictionally retained in a recess 108. The member 33 extends beyond the arm portion 35 and into the arm portion 30. The cross-bar 110 of the member 33 is rotatably received in apertures 112 in supports 32 which are spaced on each side of the vertical shaft of the member.

Figure 7:
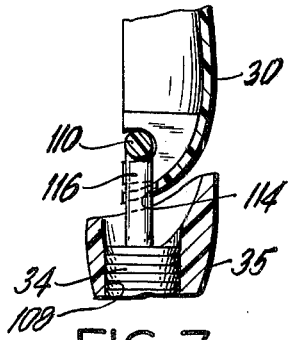
FIG. 7 is a sectional taken along line 7—7 of FIG. 5.

The connection 106 permits lower arm 35, as taken in FIG. 5, to move forwardly much like the human lower arm moves about the elbow. Slot 114 in the lower part of upper arm portion 31, through which shaft 116 of member 33 passes (see FIG. 5 and 7), prevents backward movement of shaft 116 and thus of the lower arm portion 35 beyond the vertical position of FIG. 5 so that the effect of the lower arm movement is completely life-like.

In lower arm 35 is also inserted plug 36 which is frictionally held there. Attached to plug 36 is joint 37 to which is attached hand 38. Ball 54 has a cut-out portion 55 (identical with cut-out portion 51 in ball 50) which gives ball 54 a resiliency enabling it to be frictionally fit within socket 56. Ball 54 is attached to rod 57 which has a rectangular section mated in the left shoulder of upper torso 16 preventing rotation of ball 54. The other end of rod 57 has a plug frictionally fit into a fixed receptacle 58.

Upper left arm 18 is connected to lower left arm 23 through a ball 20 frictionally fit within socket 19 to which ball is connected rod 21. Rod 21 is connected to plug 22, and, as with the right arm, that plug is frictionally held in a receptacle in lower arm 23. This permits left lower arm 23 to be moved in all directions. Lower arm 23 is connected to hand 24 in the same manner as lower right arm 35.

Left leg 26 is connected to lower leg 27 by a ball and socket joint as between upper left arm 18 and lower left arm 23. Left foot 28 is pivotally connected to lower left leg 27 in the same manner as right hand 38 is connected to right lower arm 35. Peg-leg 29 is pivotally connected to the upper right leg 25 of the toy figure by a connection identical to that between right hand 38 and lower right arm 35.

The upper torso 16 and lower torso 40 are connected by a double cup-shaped joint. The upper cup 44 (FIG. 2) is inserted and retained within upper torso 16. Upper cup 44 is connected to inverted lower cup 42 at joint 43 and lower cup 42 is similarly inserted and retained in lower torso 40.

This double cup joint permits universal movement between upper torso 16 and lower torso 40, and gives a life-like feature to the toy figure.

When the apparatus of this invention is used the person wishing to actuate the right arm of the figure pushed button 60. This lifts lever 62 (to the dotted line position shown in FIG. 2) which rotates boss 75 via loop 73. Rotation of boss 75 causes upward motion of arm portion 30 and arm portion 35 and, therefore, hand 38 and cutlass 39. Moreover, the momentum of the arm causes arm portion 35 to keep rotating upwardly relative to arm portion 30 via the connection 106 after the portion 30 has stopped rotating. Thereafter arm portion 35 falls until extension 116 engages the portion 30. Hence, a life-like effect of fencing with the cutlass 39 is imparted to the figure. Foot portion 63 of lever 62 is preferably shorter than the other end 65 of lever 62. This gives an increase in the distance which arm 30 will move in relation to button 60. As the end of 65 of lever 62 moves upwardly within loop 73 it follows a straight path and therefore cams radially inwardly within loop 73 as shown by the dotted line position in FIG. 4.

As the ball 50 is only frictionally fit into socket portion 52 the arm is free to rotate without the use of the actuating mechanism of this invention. The arm is thus free to rotate backwardly and forwardly around the ball 50 and also to move outwardly from the body. Because of the frictional fit between ball 50 and socket 52, the arm may then be returned to the lowered position shown in FIG. 1. A child using the toy may then actuate arm 30 by pushing a button 60 to raise cutlass 39 into the upper position shown in FIG. 1. After button 60 is released, spring 69 which is attached to pin 68 and held in place by slot 67 on lever 62 then returns the arm to the solid line lowered position shown in FIG. 1.

Figure 6:
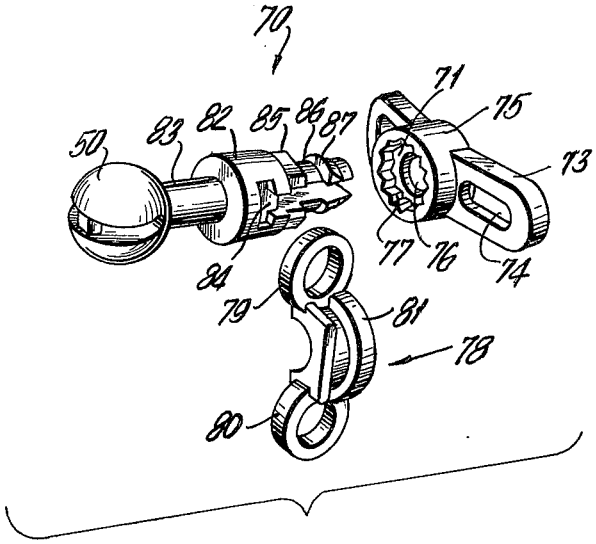
FIG. 6 is an exploded view of a clutch forming a part of the mechanism of this invention.

Another aspect of the invention is a clutch mechanism shown in exploded form in FIG. 6. Ball 50 which is positioned in upper arm 30 is integrally connected to shaft 83 to which is attached cylindrical portion 82. Attached to that cylindrical portion is a hexagon or facit portion 85 and to this is attached rod 86 and plug 87. A cut-out portion 84 gives resiliency to the assembly 82 and to plug 87. Plug 87 is inserted within opening 76 of the assembly which includes loop 73. Collar assembly 78 which is comprised of a central portion 81 and ears 79 and 80 is used, as stated, to retain cylindrical portion 82 in place as shown in FIG. 2. Ears 79 and 80 are retained in place respectively by rods 90 and 91 mated with receptacles (not shown) on the front part 17 of upper torso 16. Hexagonal portion 85 is free to be ratcheted on teeth 77. The mechanism 70 thus provides a clutch mechanism so that arm 30 which is frictionally engaged to ball 50 may be moved upwardly, or downwardly advancing or retracting hexagonal portion 85 along teeth 77. Thus arm 30 may be manually moved from a lower to a raised position and held there by that mechanism. Conversely when the arm is in a raised position and held there by that mechanism it may be returned to the lowered position shown in FIG. 1.

What is claimed is:

1. In a doll figure having a body and limbs, a limb animating mechanism, comprising:

a. operating means pivotally mounted in said body for rotation about a first axis;

b. a shaft rotatably mounted in said body and connected at one end to one of said limbs for rotating said limb about a second axis substantially perpendicular to said first axis;

c. and connecting means comprising a member connected to said shaft and having an opening therein receiving said operating means whereby pivoting of said operating means causes concomitant rotation of said shaft;

said operating means comprising a plate pivotally connected to said body, and a lever having one end connected to said plate and the other end received in said member opening, and a pivot pin pivotally mounting said lever within said body at a point intermediate its ends for rotation about said first axis.

2. A limb animating mechanism as in claim 1, in which said lever is provided with an opening rotatably receiving said pivot pin therethrough, the distance between said end of said lever connected to said shaft, and said opening being substantially greater than the distance between said opening and said end connected to said plate, whereby the moment arm of said lever is greater at said end connected to said shaft.

3. A limb animating mechanism as in claim 1, at least a radially extending ear on said members, said opening comprising an elongated opening in said ear receiving said end of said lever therethrough, whereby said lever moves radially in said slot as said shaft is rotated.

4. A limb animating mechanism as in claim 1, in which said operating means further comprises biasing means for biasing said lever to a normal position wherein said plate assumes a position lying in the plane of the outer surface of said body.

5. A limb animating mechanism as in claim 1, wherein said connecting means and said shaft are provided with complementary formed positioning means for selectively rotating said shaft to a selected one of a plurality of different positions with respect to said connecting means.

6. A limb animating mechanism as in claim 1, in which said member comprises a hollow boss having teeth about the inner periphery thereof to provide an internal gear, said shaft comprising a compressible pin extending through said body and said boss, and spaced facets on said pin engagable with selected ones of said teeth to orient said pin in a selected position, said facets being compressed together as said pin is rotated relative to said boss to permit said relative rotation.

7. In a doll figure having a body and limbs, a limb animating mechanism, comprising:

a. operating means comprising a lever pivotally mounted in said body for rotation about a first axis;

b. a shaft rotatably mounted in said body and connected at one end to one of said limbs for rotating said limb about a second axis substantially perpendicular to said first axis;

c. and connecting means comprising a member connected to said shaft and having an opening therein receiving said lever whereby pivoting of said lever causes concomitant rotation of said shaft;

said body comprising at least two segments, a member having a cup-shaped upper portion and an inverted cup-shaped lower portion, and a socket in each of said segments engaging a respective one of said cup-shaped portions to provide a universal connection between said segments.

8. In a doll figure having a body and limbs, a limb animating mechanism, comprising:

a. a lever pivotally mounted in said body for rotation about a first axis;

b. a shaft rotatably mounted in said body and connected at one end to one of said limbs for rotating said limb about a second axis substantially perpendicular to said first axis;

c. and connecting means comprising a member connected to said shaft and having an opening therein receiving said lever whereby pivoting of said lever causes concomitant rotation of said shaft;

said one limb comprising at least an upper and a lower section, said shaft being connected to said upper section, and joining means for connecting said upper and lower sections whereby said lower section is free to rotate about said upper section.

9. In the doll figure of claim 8, in which said limb comprises an arm, and said joining means is positioned at the elbow area of said arm, and stop means on said arm to prevent rearward rotation of said lower section relative to said upper section.

10. In the doll figure of claim 9, said joining means comprising a T-shaped member affixed to one of said sections and having a cross-bar extending outwardly therefrom, and spaced supports in the other of said sections rotatably receiving said cross-bar therein.

* * * * *